US007484673B2

(12) United States Patent
Boecking

(10) Patent No.: US 7,484,673 B2
(45) Date of Patent: Feb. 3, 2009

(54) FUEL INJECTOR WITH TWO-STAGE BOOSTER

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 15 days.

(21) Appl. No.: 11/632,971

(22) PCT Filed: May 13, 2005

(86) PCT No.: PCT/EP2005/052208

§ 371 (c)(1),
(2), (4) Date: Jan. 19, 2007

(87) PCT Pub. No.: WO2006/008201

PCT Pub. Date: Jan. 26, 2006

(65) Prior Publication Data

US 2008/0093482 A1 Apr. 24, 2008

(30) Foreign Application Priority Data

Jul. 21, 2004 (DE) ..... 10 2004 035 313

(51) Int. Cl.
*F02M 47/02* (2006.01)

(52) U.S. Cl. ..... 239/88; 239/102.2; 239/533.9

(58) Field of Classification Search ..... 239/88–96, 239/102.2, 533.2–533.12, 585.1, 585.2, 585.4, 239/585.5, 586
See application file for complete search history.

(56) References Cited

U.S. PATENT DOCUMENTS 5,033,442 A * 7/1991 Perr et al. ..... 123/502
6,685,105 B1 2/2004 Ruehle et al.

FOREIGN PATENT DOCUMENTS

DE 43 06 073 C1 6/1994
DE 195 19 191 A1 12/1998
WO WO 01/29403 A1 4/2001

* cited by examiner

*Primary Examiner*—Christopher S Kim
(74) *Attorney, Agent, or Firm*—Ronald E. Greigg

(57) ABSTRACT

A fuel injector for an internal combustion engine has a nozzle needle that opens or closes at least one injection opening. At an end oriented away from the at least one injection opening, the nozzle needle has a step-shaped widening, which forms an end surface oriented toward the at least one injection opening. The end surface, an end surface of a first booster, and an end surface of a second booster delimit one side of a control chamber; an actuator moves the first booster and the second booster into or out of the control chamber.

8 Claims, 2 Drawing Sheets

FUEL INJECTOR WITH TWO-STAGE BOOSTER

CROSS-REFERENCE TO RELATED APPLICATIONS

This application is a 35 USC 371 application of PCT/EP 2005/052208 filed on May 13, 2005.

BACKGROUND OF THE INVENTION

1. Field of the Invention

This invention relates to injectors of the type used to meter fuel in internal combustion engines. Particularly in autoignition engines equipped with high-pressure accumulators, the nozzle needle is hydraulically triggered to open and close the injection openings. The hydraulic pressure in the control chamber required for this is generated by means of boosters triggered by actuators.

2. Prior Art

In fuel injectors of the type used in the prior art, an actuator triggers a control valve. For example, the actuator is embodied in the form of a piezoelectric actuator or an electromagnetic actuator. The control valve opens or closes a connection from a pressurized control chamber into a low-pressure line. One side of the control chamber is delimited by an end surface of the nozzle needle that opens or closes the least one injection nozzle. Once the control valve has opened, the pressure in the control chamber drops. This simultaneously decreases the compressive force acting on the nozzle needle. Once the force oriented in the opposite direction exceeds the compressive force acting on the end surface of the nozzle needle delimiting the control chamber, then the nozzle needle moves into the control chamber, thus unblocking the at least one injection opening. In order to close the injection opening, the control valve is closed again, causing the pressure in the control chamber to increase again. Once the compressive force acting on the end surface of the nozzle needle, which increases due to the rising pressure, exceeds the forces acting on the nozzle needle in the opposite direction, then the nozzle needle moves toward the injection opening and closes it.

If a piezoelectric actuator is used as the actuator, then this design of the fuel injector means that the piezoelectric actuator is supplied with current and thus experiences a longitudinal expansion when the injection nozzles are closed. To open the injection nozzles, the voltage is simply disconnected from piezoelectric actuator. The actuator is therefore continuously supplied with current in the closed state.

Another disadvantage of the fuel injectors known from the prior art is that the high boosting ratio from the actuator to the nozzle needle of 1:4 reduces the rigidity of the injector system, particularly in the lower partial stroke, thus making it impossible to adequately shape the injection curve.

SUMMARY OF THE INVENTION

The fuel injector embodied according to the invention includes an injector housing with a bore that contains a nozzle needle. The bore widens to form a nozzle chamber that is supplied with highly pressurized fuel from a high-pressure reservoir. Between the nozzle chamber and a valve seat, the nozzle needle is encompassed by an annular gap. When the injection valve is open, fuel flows through this gap to the injection opening. When the nozzle needle is resting in the valve seat, the injection opening is closed and no fuel flows into the combustion chamber. Once the nozzle needle lifts away from the valve seat, highly pressurized fuel flows from the annular gap to the injection nozzle and is injected into the combustion chamber.

At the end oriented away from the injection opening, the nozzle needle widens out to form an end surface oriented toward the injection opening. The end surface of the nozzle needle, an end surface of a first booster, and an end surface of a second booster delimit one side of a control chamber. The control chamber is also delimited by an end surface of a lower housing part. An actuator moves the end surface of the first booster and the end surface of the second booster into or out of the control chamber.

In a preferred embodiment form, the actuator acts on a first end surface of a control piston. A second end surface of the control piston acts on the first booster. With a movement of the actuator toward the injection nozzles, the control piston and therefore the first booster is moved in the same direction. As a result, the end surface of the first booster moves into the control chamber, reducing its volume and therefore increasing the pressure in it. The increasing pressure in the control chamber increases the compressive force acting on the end surface of the nozzle needle. Once the force acting on the end surface of the nozzle needle exceeds the force acting on the nozzle needle in the opposite direction, then the nozzle needle lifts away from its seat, thus unblocking the injection opening.

With a continued movement of the actuator toward the injection openings, the second booster comes into contact with a rib on the control piston and is thus likewise moved into the control chamber. This further increases the pressure in the control chamber, causing the nozzle needle to open farther. The movement of the control piston compresses a spring element embodied in the form of a compression spring that encompasses the rib of the control piston, with its one end resting against a contact surface on the rib of the control piston and its other end resting against the second booster.

In order to close the injection opening, the actuator is moved back in the opposite direction. As a result, the control piston moves away from the injection opening, causing the first and second booster to move out of the control chamber. This increases the volume of the control chamber and reduces the pressure in it, which in turn causes the nozzle needle to move into the control chamber and therefore to close the injection openings. During the movement of the control piston away from the injection opening, the spring element that encompasses the rib on the control piston relaxes. The movement of the second booster ends as soon as the compressive and spring forces acting on the second booster reach equilibrium. The movement of the first booster ends once the actuator stops moving.

A fixed stop for terminating the movement of the second booster has the disadvantage that it is not possible to compensate for density differences due to temperature fluctuations. Thus, with a constant volume of the control chamber, a density increase causes a pressure decrease and a density decrease causes a pressure increase in the control chamber. This results in unwanted changes in the injection behavior due to the different forces required for opening and closing the nozzle needle.

Because the first booster travels into the control chamber first, the injection opening is opened quickly and precisely, with a high degree of rigidity and a low boosting ratio. When the first booster and the second booster are traveling into the control chamber, the boosting increases. As a result, a small actuator stroke produces a large opening stroke.

Coordinating the time at which the second booster travels into or out of the control chamber during the opening or closing process makes it possible to favorably shape the injection curve. This means that the injection curve can be adapted to the operation of the internal combustion engine, thus making it possible to reduce fuel consumption and increase power.

In a preferred embodiment form, the nozzle needle, the first booster, and the second booster are embodied as rotationally symmetrical; the first booster encompasses the widened end of the nozzle needle and the second booster encompasses the first booster.

In one embodiment form, a cup-shaped recess is provided in the widened end of the nozzle needle, at the end oriented away from the injection opening. The cup-shaped recess accommodates a spring element, which is preferably embodied in the form of a spiral spring, one end of which rests against the bottom of the cup-shaped recess and the other end of which rests against the first booster. When the injection opening is closed, the spring force of the spring element is greater than the force of the pressure acting on the end surface oriented toward the control chamber so that the spring force moves the nozzle needle into the valve seat. As soon as the compressive force on the end surface oriented toward the control chamber exceeds the spring force of the spring element, the nozzle needle lifts away from its seat, thus unblocking the injection opening.

In one embodiment, the second booster is encompassed by an annular element that is placed with a biting edge against the lower housing part. The inside of the annular element constitutes the lateral delimitation of the control chamber. In addition, the second booster is encompassed by a spring element embodied in the form of a compression spring, one end of which rests against an end surface of the annular element oriented away from the biting edge and the other end of which rests against a rib on the second booster. As the second booster is moved into the control chamber, this compresses the spring element, thus increasing the spring force. As soon as the control piston starts to move back again, the spring force of the spring element moves the second booster out of the control chamber again.

BRIEF DESCRIPTION OF THE DRAWINGS

The invention will be described in detail below in conjunction with the drawings, in which.

DESCRIPTION OF THE PREFERRED EMBODIMENTS

Figure 1:
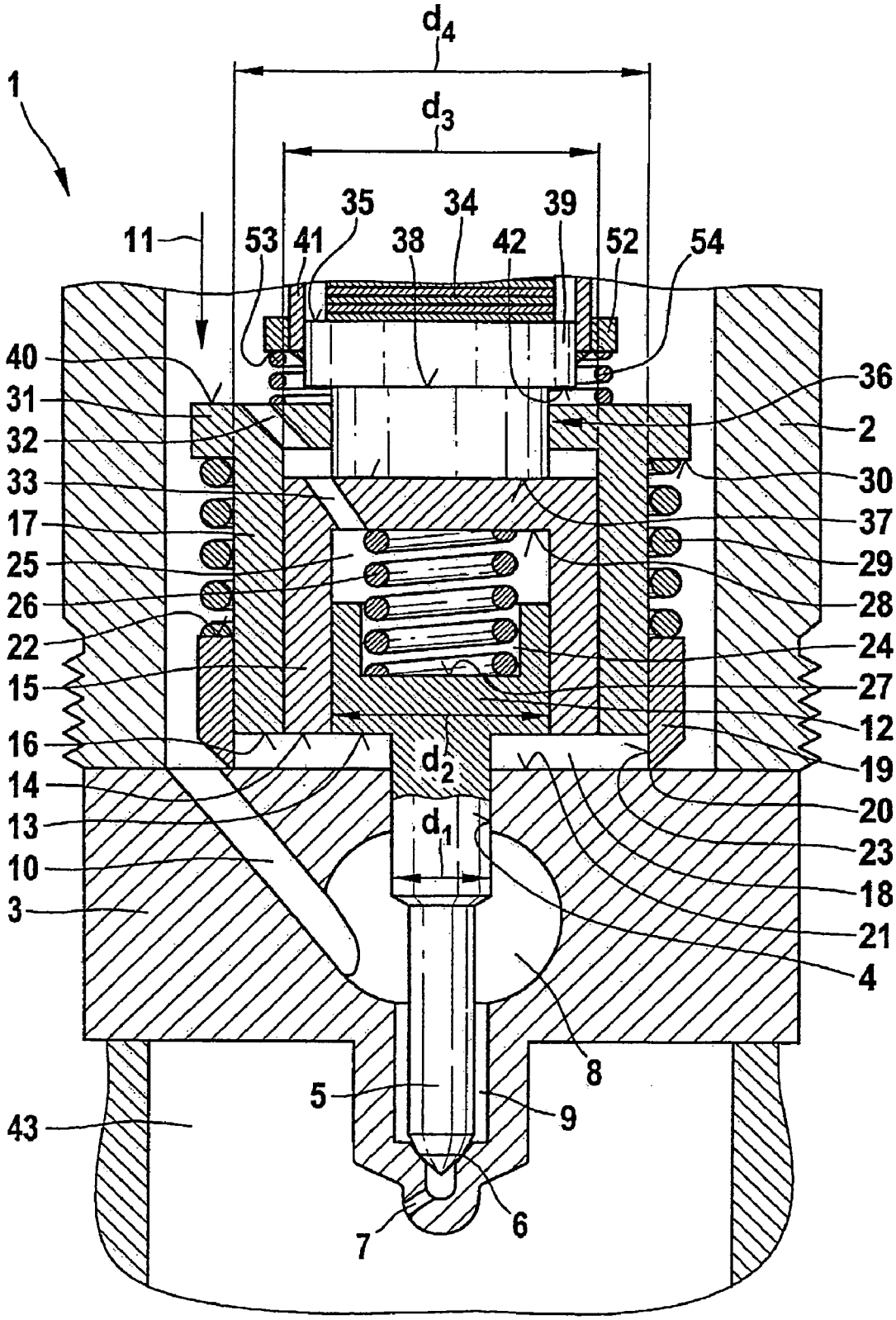
FIG. 1 shows a section through a fuel injector embodied according to the present invention.

FIG. 1 shows a section through a fuel injector embodied according to the present invention in which a fuel injector 1 has an upper housing part 2 and a lower housing part 3. The lower housing part 3 contains a bore 4 in which a nozzle needle 5 is guided. The nozzle needle 5 opens or closes at least one injection opening 7. To close the at least one injection opening 7, the nozzle needle 5 is moved into a valve seat 6. As soon as the nozzle needle 5 lifts away from the valve seat 6, a connection from the nozzle chamber 8 to the injection opening 7 via an annular gap 9 is opened, through which the fuel flows. The fuel flows into the nozzle chamber 8 via a high-pressure line 10, which is connected to a high-pressure fuel accumulator, not shown. The supply of fuel from the high-pressure fuel accumulator to the high-pressure line 10 is indicated by the arrow 11.

At the end oriented away from the at least one injection opening 7, the nozzle needle 5 has a step-shaped widening 12. The end of the step-shaped widening 12 oriented toward the at least one injection opening 7 has an end surface 13, which, together with an end surface 14 of a first booster 15 and an end surface 16 of the second booster 17, delimits one side of a control chamber 18. In the embodiment form shown in FIG. 1, the first booster 15 encompasses the step-shaped widening 12 of the nozzle needle 5. At the same time, the second booster 17 encompasses the first booster 12.

The second booster 17 is encompassed by an annular element 19 that is placed with a biting edge 20 against an upper end surface 21 of the lower housing part 3. The compressive force exerted on an end surface 22 of the annular element 19 oriented away from the biting edge 20 presses the annular element 19 against the upper end surface 21 of the lower housing part 3 in a fluid-tight fashion.

In addition to the end surface 13 of the step-shaped widening 12 of the nozzle needle 5, the end surface 14 of the first booster 15, and the end surface 16 of the second booster 17, the control chamber 18 is also delimited by the inside 23 of the annular element 19 and the upper end surface 21 of the lower housing part 3.

A cup-shaped recess 24 is provided in the step-shaped widening 12 of the nozzle needle 5, on the end oriented away from the at least one injection opening 7. The step-shaped widening 12 of the nozzle needle 5, the cup-shaped recess 24, and the first booster 15 encompass a second control chamber 25. The second control chamber 25 contains a first spring element 26, one end of which rests against the bottom 27 of the cup-shaped recess 24 and the other end of which rests against the first booster 15. In the embodiment form shown here, the first booster 15 is cup-shaped so that the first spring element 26 rests against the bottom 28 of the cup-shaped first booster 15. The first spring element 26 is preferably embodied in the form of a spiral spring that functions as a compression spring; it is also possible, however, to use any other compression spring variant known to those skilled in the art.

A second spring element 29 encompasses the second booster 17. One end of the second spring element 29 rests against the end surface 22 of the annular element 19 and the other end rests against an end surface 30 of a rib 31 provided at the end of the second booster 17 oriented away from the at least one injection opening 7.

Highly pressurized fuel is supplied to the second control chamber 25 via a bypass 32 in the bottom of the second booster 17 embodied as cup-shaped in the embodiment form shown here and via an additional bypass 33 in the bottom of the first booster 15 likewise embodied as cup-shaped in this embodiment form. When the nozzle needle 5 moves into the second control chamber 25, which decreases its volume, fuel can flow out of the control chamber 25 via the bypass 32, 33 so that the pressure in the second control chamber 25 remains constant.

An actuator 34 for controlling the nozzle needle 5 is provided in the fuel injector 1. Preferably, the actuator 34 is a piezoelectric actuator. The actuator 34 acts on an upper end surface 35 of a control piston 36. With a lower end surface 37, the control piston 36 acts on an upper end surface 38 of the first booster 15. With an end surface 42 of a rib 39 encompassing it, the control piston 36 acts on an upper end surface 40 of the second booster 17.

A tube spring 41 is attached to the rib 39 in a form-locked manner to assist the movements of the control piston 36.

In the embodiment form shown here, the tube spring 41 adjoins a rib 52 with a contact surface 53 against which one end of a third spring element 54 rests, which third spring element is embodied in the form of a compression spring. The other end of the third spring element 54 rests against the second booster 17. In the embodiment form shown in *Fig.* 1, the spring element 54 encompasses the control piston 36. The spring element 54 is preferably a spiral spring; it is also possible, however, for the spring element 54 to be embodied in the form of any other compression spring variant known to those skilled in the art.

In order to open the at least one injection opening 7, the actuator 34 is supplied with current. As a result, the actuator 34 expands in the longitudinal direction toward the at least one injection opening 7. The longitudinal expansion of the actuator 34 moves the control piston 36 and therefore the first booster 15 toward the injection opening. The movement of the first booster 15 toward the at least one injection opening 7 causes the end surface 14 of the first booster 15 to move into the control chamber 18. This reduces the volume of the control chamber 18. The control chamber 18 is filled with highly pressurized fuel by leakage flows between the first booster 15 and second booster 17, leakage flows between the first booster 15 and the step-shaped widening 12 of the nozzle needle 5, and leakage flows along the bore 4 in which the nozzle needle 5 is guided. The reduction of the volume in the control chamber 18 increases the pressure in the control chamber 18. The increasing pressure in the control chamber 18 increases the compressive force acting on the end surface 13 of the step-shaped widening 12. Once the compressive force acting on the end surface 13 exceeds the combination of the spring force of the first spring element 26 and the compressive forces acting on the step-shaped widening 12 of the nozzle needle 5 in the second control chamber 25, the nozzle needle 5 moves toward the control piston 36. As a result, the nozzle needle 5 lifts away from the valve seat 6, thus unblocking the at least one injection opening 7 and initiating the injection process.

The longitudinal expansion of the actuator 34 and the initially constant position of the second booster 17 compresses the third spring element 54 encompassing the control piston 36 until the end surface 42 of the rib 39 on the control piston 36 strikes against the upper end surface 40 of the second booster 17. With a further longitudinal expansion of the actuator 34, via the control piston 36, the actuator 34 also moves the second booster 17 toward the at least one injection opening 7. Once the upper end surface 40 of the second booster 17 has been struck by the end surface 42 of the rib 39, then both the first booster 15 and the second booster 17 are moved into the control chamber 18. This causes a further reduction of the volume in the control chamber 18 and therefore a further increase of the pressure in it. This causes the nozzle needle 5 to move farther toward the control piston 36, resulting in a further increase in the flow cross section at the valve seat 6.

When the nozzle needle 5 opens, the first spring element 26 is compressed. The shorter the distance between the bottom 27 of the cup-shaped recess 24 and the bottom 28 of the first booster 15, the greater the force required to further compress the first spring element 26. At the very latest, the movement of the nozzle needle 5 toward the control piston 36 is terminated when the spring element 26 can be compressed no further.

In the embodiment form shown here with a rotationally symmetrical nozzle needle 5 and a likewise rotationally symmetrical first booster 15 and second booster 17, if only the first booster 15 is being moved, then the boosting ratio is the ratio of the difference between the diameter $d_1$ of the nozzle needle 5 in the region of the bore 4 and the diameter $d_2$ of the nozzle needle 5 in the region of the step-shaped widening 12 to the difference between the outer diameter $d_3$ of the first booster 15 and the diameter $d_2$ of the step-shaped widening 12. The boosting ratio $d_2$-$d_1$:$d_3$-$d_2$ lies in a range from 1:1 to 1:1.5. Due to this low boosting ratio, the nozzle needle 5 is opened quickly and precisely, with a high degree of rigidity.

As soon as the second booster 17 is also being moved along with the first into the control chamber 18, then the boosting ratio is the ratio of the difference between the diameter $d_2$ of the step-shaped widening 12 and the diameter $d_1$ of the nozzle needle 5 in the region of the bore 4 to the difference between the outer diameter $d_4$ of the second booster 17 and the diameter $d_2$ of the step-shaped widening 12. The boosting ratio $d_2$-$d_1$:$d_4$-$d_2$ lies in a range from 1:4 to 1:7. Due to the high boosting ratio, even a small movement of the first booster 15 and second booster 17 into the control chamber 18 results in a powerful pressure increase and a large movement of the nozzle needle 5. For this reason, even a small stroke of the actuator 34 suffices to open the nozzle needle 5 a long way. Because the spring force in the first spring element 26 increases due to the opening of the nozzle needle 5, the opening speed decreases as the nozzle needle 5 opening progresses.

The use of the first booster 15 and second booster 17 to open the at least one injection opening 7 makes it possible to optimally adapt the injection curve to the combustion in the combustion chamber 43 by adjusting the time at which the second booster 17 is moved. Another advantage of the novel embodiment of the fuel injector 1 with the two boosters 15, 17 is that the movement of the boosters 15, 17 into the control chamber 18 in order to open the at least one injection opening 7 requires supplying the actuator 34 with voltage for the opening and disconnecting the voltage from the actuator 34 for the closing.

In order to close the at least one injection opening 7, the voltage to the actuator 34 is disconnected. This causes the actuator 34 to shorten due to the constriction of the piezoelectric crystal stack and the control piston 36, assisted by the tube spring 41, moves back toward the at least one injection opening 7. As a result of this, initially, both the first booster 15 and the second booster 17 move out of the control chamber 18. This increases the volume in the control chamber 18 and decreases the pressure in it. The pressure decrease in the pressure chamber 18 in turn reduces the compressive force acting on the end surface 13 of the step-shaped widening 12 of the nozzle needle 5. Once the compressive force acting on the end surface 13 of the step-shaped widening 12 drops below the combination of the compressive force of the first spring element 26 and the compressive force acting on the step-shaped widening in the control chamber 25, then the nozzle needle 5 moves toward the at least one injection opening 7. The second spring element 29 assists the movement of the second booster 17 toward the actuator 34. As the at least one injection opening 7 is being opened, the second spring element 29 is compressed by the movement of the second booster 17 into the control chamber 18. This increases the spring force acting on the end surface 30 of the rib 31 on the second booster 17 and acting on the end surface 22 of the annular element 19. As the at least one injection opening is being closed, this spring force of the second spring element 29 acts on the end surface 30 of the rib 31 and thus assists the movement of the second booster 17 toward the actuator 34. The spring element 29 is preferably a compression spring embodied in the form of a spiral spring. It is, however, also possible to embody the spring element 29 in the form of any other compression spring variant known to those skilled in the art. The stress on the third spring element 54 is relieved once again with further shortening of the actuator 34 and therefore movement of the control piston 36 toward the actuator 34 due to the disconnection of the supply of current and the resulting contraction of the piezoelectric crystal stack of the actuator 34. The movement of the second booster 17 is stopped at the initial position due to the force equilibrium reached between the compressive forces acting on the end surfaces 16, 40 and the spring forces of the second spring element 29 and third spring element 54.

The continued movement of the control piston 36 toward the actuator 34 causes the first booster 15, assisted by the spring force of the first spring element 26, to likewise move farther toward the actuator 34. As a result of this, the end surface 14 of the first booster 15 moves farther out from the control chamber 18, which increases the volume of the control chamber 18 and thus decreases the pressure in it. The further pressure decrease in the control chamber 18 causes the nozzle needle 5 to move farther toward the at feast one injection opening 7 until the nozzle needle 5 comes to rest in the valve seat, thus closing the at least one injection opening 7.

Figure 2:
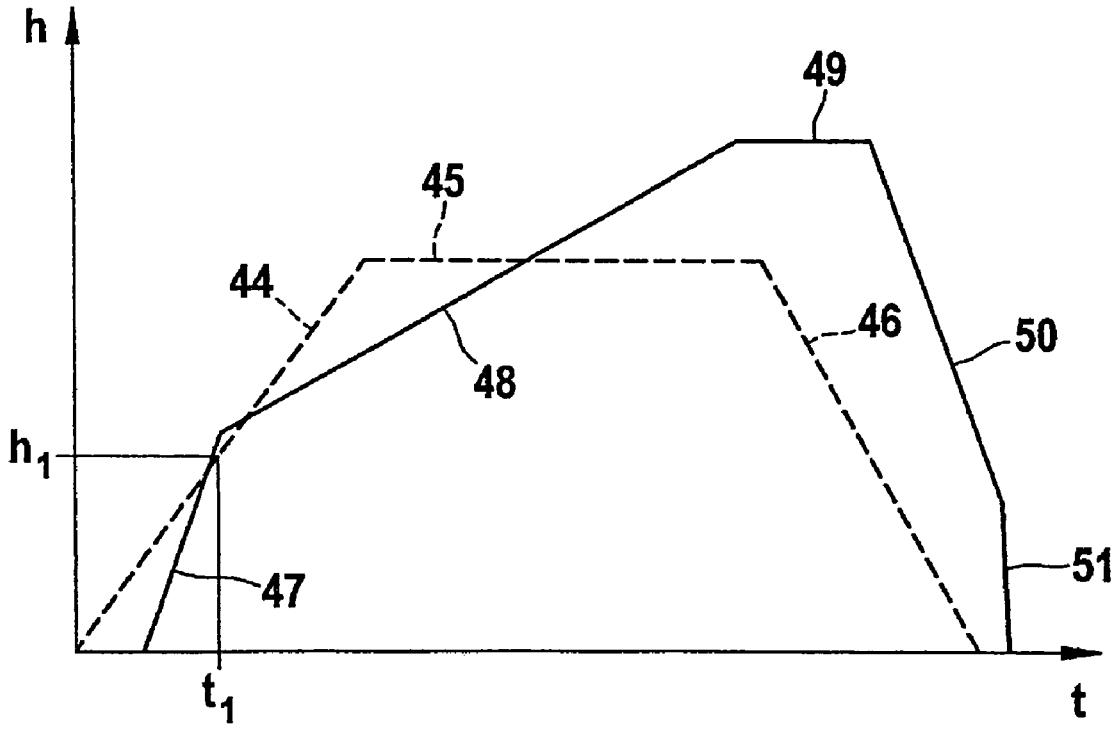
FIG. 2 shows the chronological curve of the actuator stroke and needle stroke of a fuel injector according to the present invention.

FIG. 2 shows the chronological curves of the actuator stroke and the needle stroke. In the graph in FIG. 2, time t is plotted on the abscissa and the stroke h is plotted on the ordinate. To initiate the injection process, the actuator 34 is supplied with current. As soon as a voltage is supplied to the actuator 34, its piezoelectric crystal stack begins to expand. From the beginning of the expansion of the actuator 34 to time $t_1$, the firstbooster 15 begins to move into the control chamber 18. At time $t_1$, the end surface 42 of the rib 39 strikes against the upper end surface 40 of the second booster 17 and begins to also move the latter toward the control chamber 18. The elongation of the actuator 34 is labeled with the reference numeral 44. If the actuator 34 reaches its maximum length and continues to be supplied with current, then its length changes no further. The time interval of the maximum stroke of the actuator 34 is labeled with the reference numeral 45. In order to terminate the injection process, the voltage to the actuator 34 is disconnected. This causes its piezoelectric crystal stack to shrink back to the original length. In the graph in FIG. 2, this is depicted by the curve section 46. With a slight time delay after the supply of current to the actuator 34 begins, the nozzle needle 5 starts to lift away from the valve seat 6. The rapid opening motion of the nozzle needle 5 is depicted by the curve section 47. Once the second booster 17 begins at time $t_1$ to also move into the control chamber 18, the opening speed of the nozzle needle 5 begins to decrease. This is shown by the flatter course of the curve 48. The decrease in the opening speed results from the increasing force exerted on the actuator 34. This decreases the speed with which the piezoelectric crystals expand.

The opening process of the nozzle needle 5 is stopped by the compression of the first spring element 26 or by contact with a stop not shown here. For this reason, the stroke of the nozzle needle 5 changes no further, as indicated by reference numeral 49. As soon as the supply of current to the actuator 34 is interrupted and the actuator begins to shorten again, initially, both boosters 15, 17 move out from the control chamber 18. With a slight time delay, the nozzle needle 5 also begins to move toward the injection opening 7 again. As long as both the first booster 15 and second booster 17 are moving, the nozzle needle 5 moves slowly, as indicated by the reference numeral 50. The closing speed of the nozzle needle increases further as soon as only the first booster 15 is moving out from the control chamber 18. This is depicted in the curve section labeled with the reference numeral 51.

The foregoing relates to a preferred exemplary embodiment of the invention, it being understood that other variants and embodiments thereof are possible within the spirit and scope of the invention, the latter being defined by the appended claims.

REFERENCE NUMERAL LIST

1 fuel injector
2 upper housing part
3 lower housing part
4 bore
5 nozzle needle
6 valve seat
7 injection opening
8 nozzle chamber
9 annular gap
10 high-pressure line
11 fuel supply
12 step-shaped widening
13 end surface
14 end surface of first booster 15
15 first booster
16 end surface of second booster 17
17 second booster
18 control chamber
19 annular element
20 biting edge
21 upper end surface of lower housing part 3
22 end surface of annular element 19
23 inside of annular element 19
24 cup-shaped recess
25 second control chamber
26 first spring element
27 bottom of cup-shaped recess 24
28 bottom of first booster 15
29 second spring element
30 end surface of rib 31
31 rib
32 bypass in second booster 17
33 bypass in first booster 15
34 actuator
35 upper end surface of control piston 36
36 control piston
37 lower end surface of control piston 36
38 upper end surface of first booster 15
39 rib on control piston 36
40 upper end surface of second booster 17
41 tube spring
42 end surface
43 combustion chamber
44 elongation of actuator
45 maximum stroke of actuator
46 shortening of actuator
47 first opening section of nozzle needle 5
48 second opening section of nozzle needle 5
49 maximum opening stroke of nozzle needle 5
50 first closing section of nozzle needle 5
51 second closing section of nozzle needle 5
52 rib
53 contact surface
54 third spring element
$d_1$ diameter of nozzle needle 5 in the region of bore 4
$d_2$ diameter of step-shaped widening 12
$d_3$ outer diameter of first booster 15
$d_4$ outer diameter of second booster 17
h stroke
$h_1$ stroke
t time
$t_1$ time

The invention claimed is:

1. A fuel injector for an internal combustion engine, comprising:

a nozzle needle that opens or closes at least one injection opening;

a step-shaped widening on the nozzle needle disposed at an end of the nozzle needle oriented away from the at least one injection opening, the step-shaped widening forming an end surface oriented toward the at least one injection opening;

a first booster and a second booster each having an end surface oriented toward the at least one injection opening, wherein the second booster encompasses the first booster;

a control chamber delimited collectively by the end surfaces of the first booster and the second booster which end surfaces are exposed to the control chamber and by the end surface of the step-shaped widening of the nozzle needle which end surface is exposed to the control chamber; and an actuator which moves the first booster and the second booster into or out of the control chamber.

2. The fuel injector according to claim 1, wherein the first booster encompasses the step-shaped widening of the nozzle needle.

3. The fuel injector according to claim 1, farther comprising a control piston having upper and lower ends, and wherein the actuator acts on the upper end surface of the control piston and the lower end surface of the control piston in turn acts on an upper end surface of the first booster.

4. The fuel injector according to claim 3, wherein the control piston comprises a rib having an end surface acting on the second booster.

5. The fuel injector according to claim 2, further comprising a cup-shaped recess embodied in the step-shaped widening of the nozzle needle, on the end oriented away from the at least one injection opening.

6. The fuel injector according to claim 5, further comprising a second control chamber between the first booster and the step-shaped widening of the nozzle needle, a spring element in the second control chamber, which spring element has one end of resting against the bottom of the cup-shaped recess and the other end of the spring element resting against the bottom of the first booster.

7. The fuel injector according to claim 1, further comprising an annular element encompassing the second booster, which encompassing annular element has a biting edge placed against an upper end surface of a lower housing part and which has an inside delimiting the control chamber.

8. The fuel injector according to claim 7, further comprising a spring element encompassing the second booster, one end of the spring element resting against an end surface of the annular element oriented away from the biting edge and the other end of the spring element resting against an end surface of a rib on the second booster.

* * * * *